US007396050B2

(12) United States Patent
Marioni

(10) Patent No.: US 7,396,050 B2
(45) Date of Patent: Jul. 8, 2008

(54) SLEEVE-LIKE DEVICE FOR THE HYDRAULIC CONNECTION BETWEEN AN EXTERNAL SYNCHRONOUS MOTOR ELECTROPUMP AND WASHING MACHINE

(75) Inventor: Elio Marioni, Dueville (IT)

(73) Assignee: Askoll Holding S.r.l. (IT)

( * ) Notice: Subject to any disclaimer, the term of this patent is extended or adjusted under 35 U.S.C. 154(b) by 0 days.

(21) Appl. No.: 11/333,698

(22) Filed: Jan. 17, 2006

(65) Prior Publication Data

US 2006/0157986 A1 Jul. 20, 2006

(30) Foreign Application Priority Data

Jan. 17, 2005 (EP) ..... 05425015

(51) Int. Cl.
*F16L 21/00* (2006.01)

(52) U.S. Cl. ..... 285/235; 285/148.23; 464/175

(58) Field of Classification Search ..... 285/235, 285/236, 237, 148.23, 148.26, 148.18, 417; 277/636; 464/175
See application file for complete search history.

(56) References Cited

U.S. PATENT DOCUMENTS

| | | | | | |
|---|---|---|---|---|---|
| 3,016,161 | A | * | 1/1962 | Peplin | 220/86.2 |
| 3,063,266 | A | * | 11/1962 | Rabson | 464/174 |
| 3,471,179 | A | * | 10/1969 | Sixt | 285/148.22 |
| 3,542,594 | A | | 11/1970 | Smith et al. | |
| 3,630,550 | A | * | 12/1971 | Zine, Jr. | 285/235 |
| 3,837,917 | A | | 9/1974 | Jenkins et al. | |
| 4,109,097 | A | * | 8/1978 | Berry | 174/86 |
| 4,278,262 | A | * | 7/1981 | Mizutani et al. | 277/636 |
| 4,547,005 | A | * | 10/1985 | Soederhuyzen | 285/58 |
| 4,673,188 | A | * | 6/1987 | Matsuno et al. | 277/636 |
| 4,693,484 | A | * | 9/1987 | Ukai et al. | 277/636 |
| 4,763,695 | A | * | 8/1988 | Dooley | 138/109 |
| 4,878,389 | A | * | 11/1989 | Boge | 277/636 |
| 5,006,376 | A | * | 4/1991 | Arima et al. | 277/636 |
| 5,027,665 | A | * | 7/1991 | Hayward | 277/18.1 |
| 5,236,204 | A | * | 8/1993 | Hempel | 277/636 |
| 5,305,903 | A | * | 4/1994 | Harde | 220/86.2 |
| 5,391,064 | A | * | 2/1995 | Lopez | 417/423.14 |
| 5,765,837 | A | * | 6/1998 | Schwarzler | 277/636 |
| 6,189,550 | B1 | | 2/2001 | Stickel et al. | |
| 6,227,748 | B1 | * | 5/2001 | Hayward et al. | 403/50 |
| 6,306,046 | B1 | * | 10/2001 | Didszuhn | 464/175 |
| 6,328,498 | B1 | * | 12/2001 | Mersch | 403/175 |
| 6,361,444 | B1 | * | 3/2002 | Cheney et al. | 464/175 |
| 6,394,505 | B1 | * | 5/2002 | Schmucki et al. | 285/148.26 |
| 6,854,770 | B2 | * | 2/2005 | Leblanc | 285/230 |
| 2002/0034983 | A1 | * | 3/2002 | Saito et al. | 464/175 |
| 2003/0144060 | A1 | * | 7/2003 | Fuchs et al. | 464/175 |
| 2005/0236779 | A1 | * | 10/2005 | You | 277/636 |
| 2006/0116213 | A1 | * | 6/2006 | Ohshita | 464/175 |

* cited by examiner

*Primary Examiner*—James M Hewitt
(74) *Attorney, Agent, or Firm*—Akerman Senterfitt

(57) ABSTRACT

A coupling device for a dishwasher pump with a synchronous motor and external stator, comprising a first tang connected to the delivery tube of the pump, a second tang connected to the suitable pipeline of a washing tank and a connection mean part. The connection mean part comprises a frustum of cone-shaped section, intermediate between said first and second tang and a flexible annular lip formed between said second tang and the smallest base of the frustum of cone-shaped section. Advantageously, the external part of the frustum of cone-shaped section is reinforced with annular ribs.

12 Claims, 2 Drawing Sheets

SLEEVE-LIKE DEVICE FOR THE HYDRAULIC CONNECTION BETWEEN AN EXTERNAL SYNCHRONOUS MOTOR ELECTROPUMP AND WASHING MACHINE

FIELD OF APPLICATION

The present invention relates to an sleeve-like device of hydraulic connection between a synchronous motor electropump having external stator, in particular for washing machines.

More in particular the invention relates to en electropump and the hydraulic connection mode between the electropump and the washing tank of a washing machine or dishwasher.

PRIOR ART

The use of synchronous electric motors having external stator, such as operation units of washing machine electropump groups, is known in the technique.

It is known that, although advantageous under several points of view, said motors have a known drawback which has not been overcome up to now and which is essentially made of an amplification of the mechanical vibrations generated thereby and transmitted to the dishwasher tank with subsequent increase of the operation noise.

Normally, an electric motor of the considered type is supplied at 50 Hz and the vibration frequency is of 100 Hz. The vibration frequencies are considerable for the tank structure up to 400 Hz, i.e. the vibrations generated by the motor and by the confirmation of the pump bring about strong vibrations of the tank, and thus noise, up to the aforesaid limit.

In the state of the art there has been an attempt to limit the transmission of said vibrations by interposing between the pump and the tank some flexible couplings so as to decrease the vibration transmitted to the washing tank.

The suction coupling, the one placed in axis with the centrifugal pump, is less stressed by the vibrations due to its coaxiality, whereas the coupling of the pump delivery with the proper pipeline, which is necessarily fixed to the washing tank, has greater vibration transmission problems due to their width, also increased by the radial distance from the pump axis.

Not last, the coupling of the pump delivery must resist also to the strong delivery pressure and to the high temperature the washing liquid can reach in operation.

The technical problem underlying this invention is that of devising a substantially sleeve-like device for the hydraulic connection of the delivery duct of an electropump of the aforesaid type, to the washing tank of a respective dishwasher, having such structural and functional characteristics as to overcome the drawbacks cited with reference to the known technique or, at least, such as to reduce in a substantial way the transmission of the vibrations generated by the electropump electric motor, to said washing tank.

Another aim of the invention is that of reducing, if not of eliminating, the "transmission" of the vibrations generated by the electropump of a dishwasher, to the washing tank of the dishwasher itself.

Another aim of the present invention is that of realising a coupling confirmation that, besides limiting the vibration transmission, also allows to be employed with high delivery pressure of the washing liquid and at high temperature.

SUMMARY OF THE INVENTION

The solution idea underlying the present invention is that of neutralising, absorbing the aforesaid vibrations in the connection section electropump-tank.

On the basis of such solution idea the technical problem is solved by an hydraulic coupling pump-tank, substantially structured as elastic damper.

In particular, such coupling is preferably structured with a frustum of cone-shaped section, with conicity facing the direction of the washing water stream (i.e. facing the washing tank), and realised in a suitable elastic material, with external conical wall equipped with coaxial annular ribs having an helical spring-like, besides stiffening, effect.

Even more in particular, the problem is solved according to the invention by an electropump of the considered type having a delivery duct to be connected to the washing tank of a dishwasher, characterised in that said substantially sleeve-like device integrally comprises:

- a first substantially cylindrical tang for the connection to said delivery duct;
- a second substantially cylindrical tang for the connection to the washing tank;
- a frustum of cone-shaped section, intermediate between said first and second tang;
- a flexible annular lip formed between said first tang and the smallest base of said frustum of cone-shaped intermediate section.

The characteristics and advantages of the pump equipped with coupling according to the invention will be apparent from the following description of an embodiment given by way of indicative and non-limiting example with reference to the annexed drawings.

DETAILED DESCRIPTION OF A PREFERRED EMBODIMENT

Figure 1:
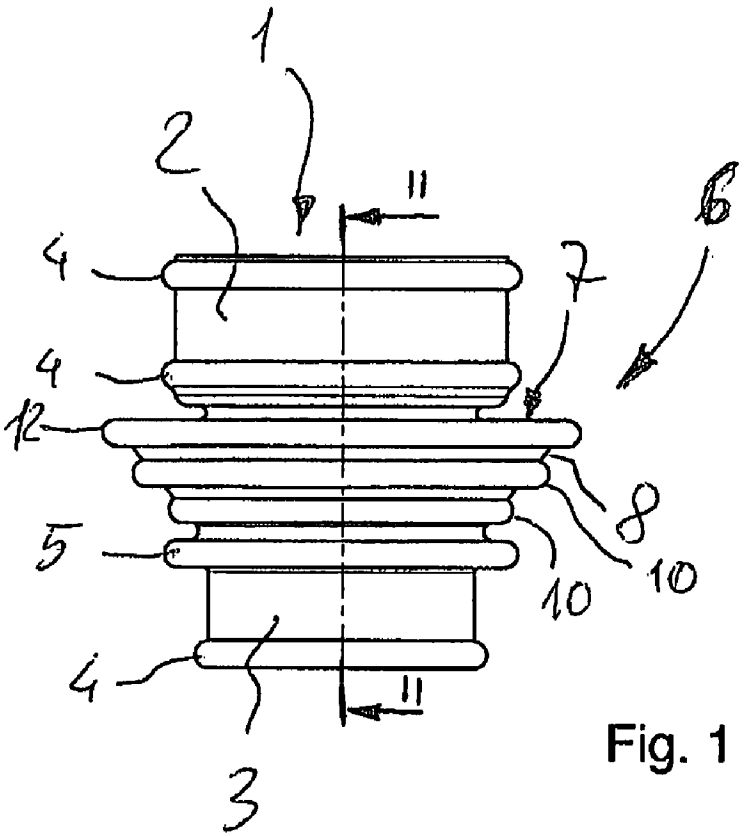
FIG. 1 shows a schematic side section of the coupling according to the invention.
Figure 2:
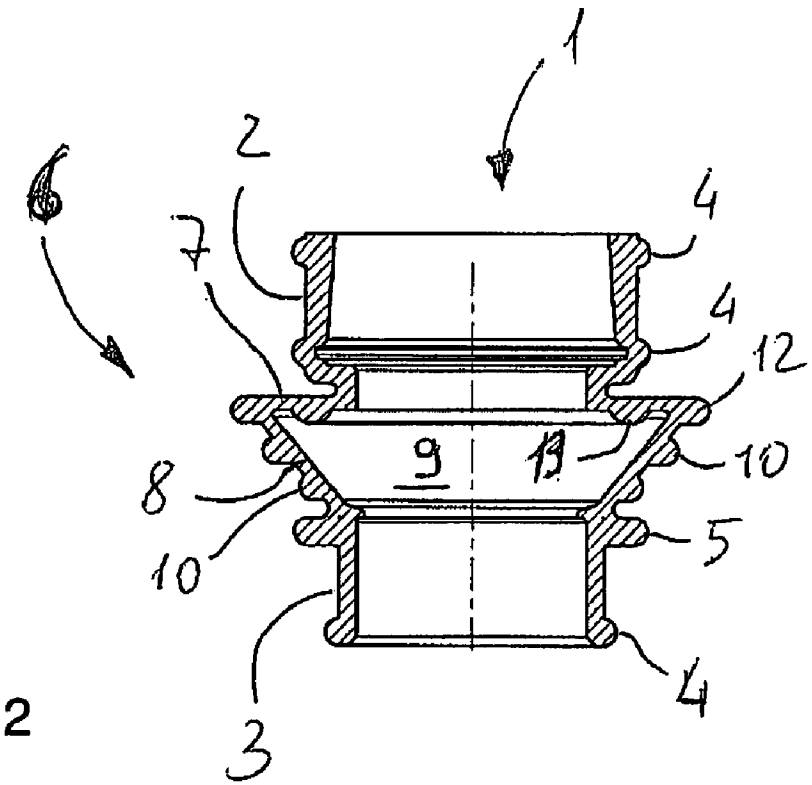
FIG. 2 shows a schematic axial section taken along the line II-II of FIG. 1.

With reference to these figures, and in particular to the embodiment of the coupling device of FIGS. 1 and 2, 1 globally indicates a coupling realised according to the present invention for allowing the hydraulic connection between an electropump and a washing tank of a washing machine.

The coupling 1 is made of a first tang 2 for the connection with a delivery tube of the pump, not shown in the drawings since conventional.

The coupling 1 also comprises a second tang 3 for the connection with a pipeline of the washing tank intended for the distribution of the washing liquid.

Each tang has external reinforcing annular ribs 4, for making the grip safe, and the second tang 3 also has a flexible annular lip 5 in the connection position with the mean part or intermediate section 7 of the coupling 1.

The mean part 7 of the coupling 1 is frustum of cone-shaped and it is integrally formed with the aforesaid annular lip 5 which has the function of dampening the axial vibrations.

Seen in section, the smallest base of the frustum of cone-shaped mean part 7 of the coupling 1 is filleted to said second tang 3 in correspondence with the annular lip 5.

The frustum of cone-shaped mean part 7 comprises a frustum of cone-shaped external wall 8 which has equidistant annular ribs 10, of which, the greatest 12 placed in correspondence with the greatest base of the frustum of cone, is filleted with the first tang 2.

Internally, in correspondence with the greatest base of the frustum of cone-shaped mean part 7 an inner annular rib 13 is further provided to reinforce the greatest external rib 12.

Figure 4:
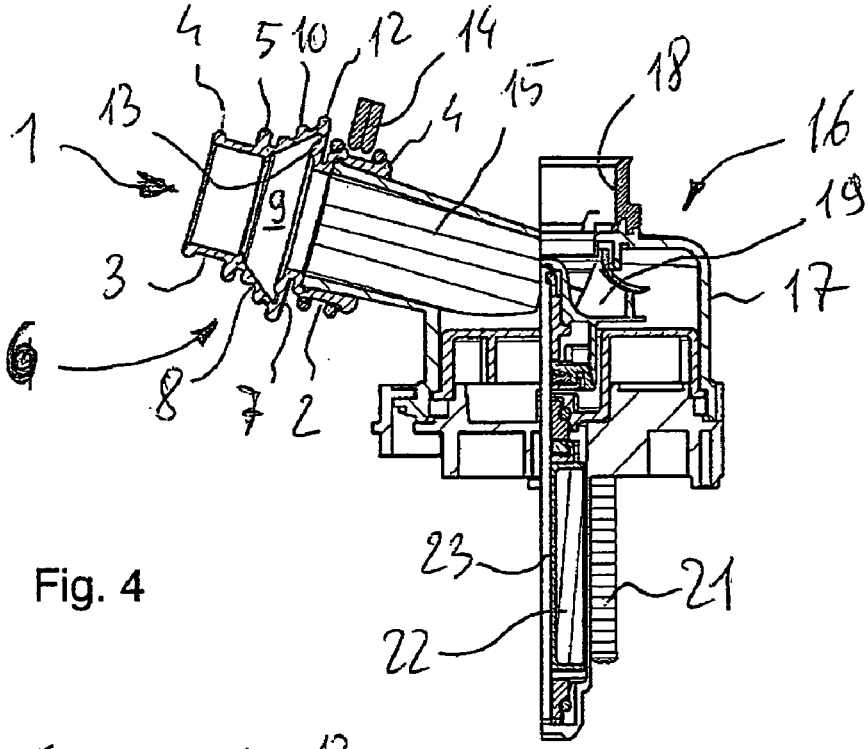
FIG. 4 shows a schematic section, taken along the line IV-IV of FIG. 3.
Figure 3:
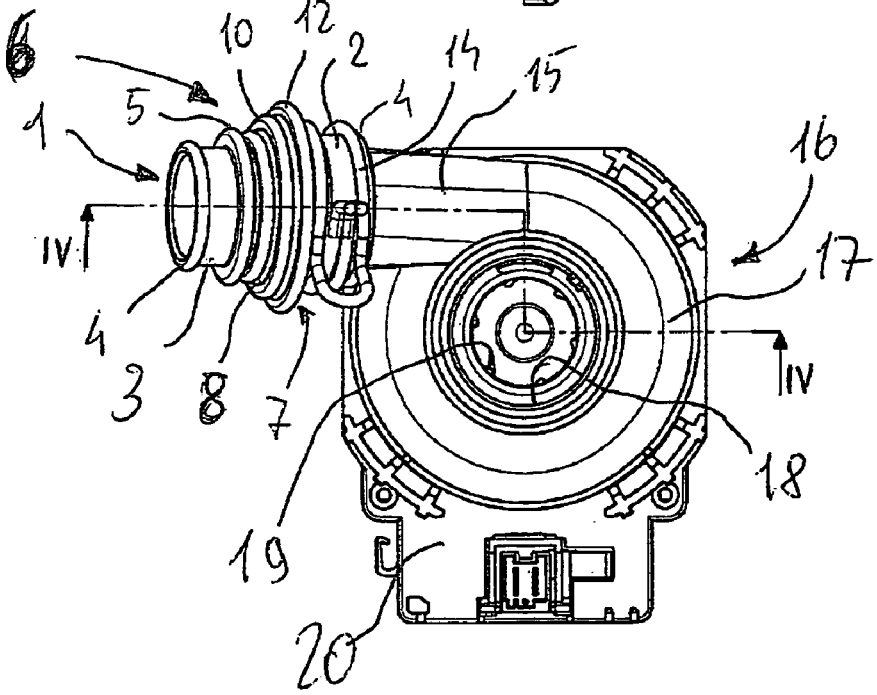
FIG. 3 shows a schematic view in axial direction on the suction side of the electropump group for dishwasher.

With further reference to FIGS. 3 and 4, besides the coupling 1, also a spring-like clamp 14 for clamping the tang 2 to the delivery tube 15 of the centrifugal pump 16 can be seen. A casing 17 of the pump 16 has an axial inlet port 18, within which an impeller 19 can be seen.

An external stator electric motor 20 is arranged out of axis with respect to the pump 16.

Polar shoes 21 wind a "diapason-like" rotor 22 which is rotation connected, in a known way, to the impeller 19 on a same driving shaft 23, obviously in axis with the pump 16. This out of axis arrangement of the stator 20 leads to amplify the vibrations the electropump group transmits to the washing tank, in fact in case of use of a closed stator the vibrations are not an insuperable problem as in the case of use of an external stator shown in the figures.

The operation of the sleeve-like device according to the present invention occurs as follows. The electropump 16 during the operation generates the vibrations stimulated by the own frequencies of the external stator synchronous electric motor.

In fact, the polar shoes 21, "diapason-like" shaped, together with the bipolar rotor double the 50 Hz supply frequency of the motor to 100 Hz; moreover, the distribution of the mass of the stator 20 with respect to the axis of the pump 16 amplifies the vibration effect since the stator mass is out of axis as, out of need, the delivery tube 15 of the pump is.

Thus, the coupling 1 is stimulated to axial and radial movements with respect to its own axis and to the axis of the suitable pipeline.

The coupling 1 according to the invention is interposed in the connection between said delivery tube 15 of the pump and the suitable pipeline of the washing tank considerably interrupting the vibration transmission. The axial movements along the coupling axis are compensated for the flexibility of the mean part 7 of the coupling.

So as to use a sufficiently flexible material of the known type for use in the couplings of the dishwasher, the confirmation of the mean part 7 provides the reinforcing ribs 10, which are advantageously annular-like shaped and placed on the external wall 8 of the frustum of cone-shaped section.

The strength of the frustum of cone-shaped mean section 7 is ensured also by the reinforcing inner rib 13.

The ribs 10, 12 and 13, as well as the lip 5, realise a sort of ring of the frustum of cone-shaped mean section 7 and allow it to remain flexible also under delivery pressures and at high operation temperatures, 70-80°C., typical of the dishwashers without deforming.

From tests carried out at the Applicant's the adoption of a flexible coupling according to the invention has allowed to halve the vibration transmission from the electropump to the washing tank to the complete advantage of the machine noise.

Obviously, a technician in the field, with the aim of satisfying specific, contingent needs, will bring several modifications to the above described coupling, all within the scope of protection of the present invention as defined by the following claims.

The invention claimed is:

1. A coupling device for an electropump having a delivery duct to be connected to a washing tank of a dishwasher, wherein the coupling device integrally comprises:

a first substantially cylindrical tang for connection to the delivery duct;

a second substantially cylindrical tang for connection to the washing tank;

a frustum of cone-shaped section, intermediate said first and said second tang, said frustum having its smallest diameter end adjacent said second tang and having its largest diameter end adjacent said first tang, such that the conicity of the frustum faces in the direction of water flow from the first tang to the second tang;

a flexible annular lip formed between said second tang and said smallest diameter end of said frustum, said flexible annular lip extending outwardly from an external wall of said coupling device to dampen axial vibrations in the coupling device; and stiffening annular ribs arranged on the external wall of said frustum of cone-shaped section, an internal wall of said frustum of cone-shaped section that is interior to said stiffening annular ribs being generally smooth.

2. The coupling device according to claim 1, wherein the coupling device comprises an inner annular rib extending axially from an inner base wall of the frustum of cone-shaped section.

3. The coupling device according to claim 1, wherein the annular ribs are integrally formed with the same material as the one used for the coupling.

4. The coupling device according to claim 1, wherein the coupling device has annular pads on said first and second tang for the reinforcement thereof and the safe grip of clamping clamps.

5. The coupling device according to claim 1, wherein the annular ribs are equidistant from one another.

6. A coupling device for an electropump having a delivery duct to be connected to a washing tank of a dishwasher. wherein the coupling device integrally comprises:

a first substantially cylindrical tang for connection to the delivery duct;

a second substantially cylindrical tang for connection to the washing tank;

a frustum of cone-shaped section, intermediate said first and second tang; and a flexible annular lip formed between said second tang and the smallest base of said frustum, said flexible annular lip extending outwardly from an external wall of said coupling device to dampen axial vibrations in the coupling device, wherein the first and second substantially cylindrical tangs and the frustum of cone-shaped section are substantially the same axial length, such that the overall axial length of the coupling device is approximately three times the axial length of the first tang, second tang or the frustum section, and wherein the coupling device comprises stiffening annular ribs arranged on an external wall of said frustum of cone-shaped section.

7. The coupling device according to claim 6, wherein the annular ribs are integrally formed with the same material as the one used for the coupling.

8. The coupling device according to claim 6, wherein the annular ribs are equidistant from one another.

9. A coupling device for an electropump having a delivery duct to be connected to a washing tank of a dishwasher, wherein the coupling device integrally comprises:

a first substantially cylindrical tang for connection to the delivery duct;

a second substantially cylindrical tang for connection to the washing tank;

a frustum of cone-shaped section, intermediate said first and second tang;

a flexible annular lip formed between said second tang and the smallest base of said frustum said flexible annular lip extending outwardly from an external wall of said coupling device to dampen axial vibrations in the coupling device; and an inner annular rib extending axially from an inner radially extending base wall at a largest diameter end of the frustum of cone-shaped section, wherein the coupling device comprises stiffening annular ribs arranged on an external wall of said frustum of cone-shaped section.

10. The coupling device according to claim 9, wherein the inner annular rib is situated on the inner base wall of the frustum of cone-shaped section so that it reinforces an external stiffening annular rib nearest the first substantially cylindrical tang.

11. The coupling device according to claim 9, wherein the annular ribs are integrally formed with the same material as the one used for the coupling.

12. The coupling device according to claim 9, wherein the annular ribs are equidistant from one another.

* * * * *